US010889135B2

(12) United States Patent
Smith et al.

(10) Patent No.: US 10,889,135 B2
(45) Date of Patent: Jan. 12, 2021

(54) PAPER FEEDING MECHANISM

(71) Applicant: Hewlett-Packard Development Company, L.P., Spring, TX (US)

(72) Inventors: Ryan M Smith, San Diego, CA (US); Keng Leong Ng, Singapore (SG); Eric Andersen, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/329,881

(22) PCT Filed: Sep. 12, 2016

(86) PCT No.: PCT/US2016/051304

§ 371 (c)(1),
(2) Date: Mar. 1, 2019

(87) PCT Pub. No.: WO2018/048441

PCT Pub. Date: Mar. 15, 2018

(65) Prior Publication Data

US 2019/0217636 A1 Jul. 18, 2019

(51) Int. Cl.

| | |
|---|---|
| ***B65H 5/06*** | (2006.01) |
| ***B41J 11/00*** | (2006.01) |
| ***B41J 13/10*** | (2006.01) |
| ***B41J 13/00*** | (2006.01) |
| ***G03G 15/00*** | (2006.01) |

(52) U.S. Cl.

CPC ..... *B41J 11/006* (2013.01); *B41J 13/00* (2013.01); *B41J 13/103* (2013.01); *B65H 5/062* (2013.01); *G03G 15/602* (2013.01); *B65H 2402/441* (2013.01); *B65H 2404/144* (2013.01); *B65H 2404/1521* (2013.01); *B65H 2404/6111* (2013.01); *B65H 2405/3321* (2013.01); *B65H 2601/11* (2013.01); *B65H 2801/06* (2013.01);

(Continued)

(58) Field of Classification Search

CPC ..... G03G 2215/00341; G03G 15/602; B65H 2402/441; B65H 2404/1521; B65H 2404/144; B65H 2404/1442; B65H 2601/11; B65H 2801/39

USPC ..... 399/367

See application file for complete search history.

(56) References Cited

U.S. PATENT DOCUMENTS

| | | | |
|---|---|---|---|
| 5,000,594 | A | 3/1991 | Beehler et al. |
| 6,139,011 | A | 10/2000 | Huang et al. |

(Continued)

FOREIGN PATENT DOCUMENTS

| | | |
|---|---|---|
| EP | 0865928 | 9/1998 |
| JP | 7112847 A | 5/1995 |
| JP | 3160365 U | 6/2010 |

*Primary Examiner* — Jeremy R Severson

(74) *Attorney, Agent, or Firm* — HP Inc. Patent Department

(57) ABSTRACT

A mechanism for an ADF having upper and lower trays, a base connecting the trays, and a cover pivotally connected to the upper tray includes a housing provided within the base and movable relative thereto. A transmission has a gripping position for transporting paper along a path from the upper tray to the lower tray and a release position allowing a paper jam along the path to be remedied. The cover is pivotable between a first condition maintaining the transmission in the gripping position and a second condition allowing the housing to move relative to the trays to place the transmission in the release position.

13 Claims, 11 Drawing Sheets

(52) U.S. Cl.
CPC ..... *B65H 2801/39* (2013.01); *G03G 2215/00341* (2013.01)

(56) References Cited

U.S. PATENT DOCUMENTS

| | | | | |
|---|---|---|---|---|
| 6,581,923 | B2 * | 6/2003 | Takamatsu | G03G 15/60 271/125 |
| 7,455,294 | B2 * | 11/2008 | Lin | B65H 5/062 271/264 |
| 7,530,563 | B2 | 9/2009 | Kuo | |
| 7,984,907 | B2 | 7/2011 | Chen | |
| 8,002,264 | B2 | 8/2011 | Matsushima | |
| 8,360,425 | B2 | 1/2013 | Chng et al. | |
| 8,419,006 | B2 * | 4/2013 | Imura | B65H 85/00 271/3.14 |
| 8,474,818 | B2 * | 7/2013 | deJong | B65H 5/062 271/273 |
| 9,617,096 | B2 * | 4/2017 | Kii | B65H 7/00 |
| 2014/0003851 | A1 * | 1/2014 | Ito | H04N 1/00543 399/367 |

* cited by examiner

PAPER FEEDING MECHANISM

BACKGROUND

Automatic document feeders (ADFs) transport paper, documents or other media between storing and receiving trays to allow the media to be scanned, copied, etc. The ADF utilizes a transmission having a series of motors and rollers to transport the media between trays.

DETAILED DESCRIPTION

Figure 1:
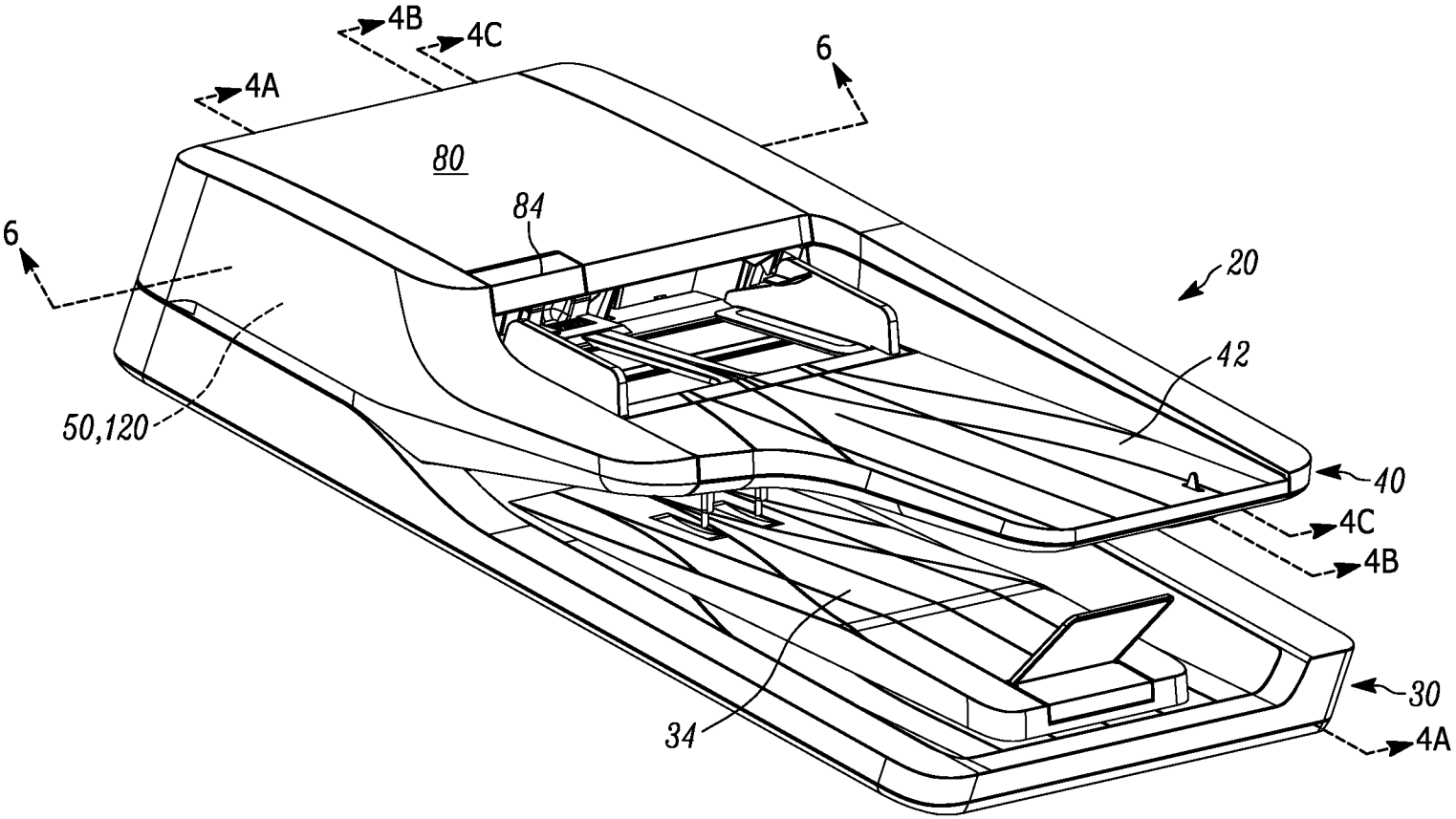
FIG. 1 is a schematic illustration of an example ADF having a paper feeding mechanism.

FIGS. 1-7 illustrate an example ADF 20 and paper feeding mechanism 120. The ADF 20 can constitute part of an all-in-one printer, printer, fax machine, photocopier or scanner having a computer, user interface, and standard copying, scanning, internet, etc. capability. The ADF 20 includes a lower tray 30, an upper tray 40, and a base 50 that connects the trays to one another. The upper tray 40 is generally rectangular and defines an area 42 for storing paper, documents or other media. The lower tray 30 is generally rectangular and defines an area 34 for receiving paper, documents or other media from the storing area 42 of the upper tray 40. The paper feeding mechanism 120 within the ADF 20 transports the paper from the upper tray 40 to the lower tray 30. A cover 80 pivotably mounted to the upper tray 40 includes a handle 84 for facilitating pivotal movement.

Figure 2:
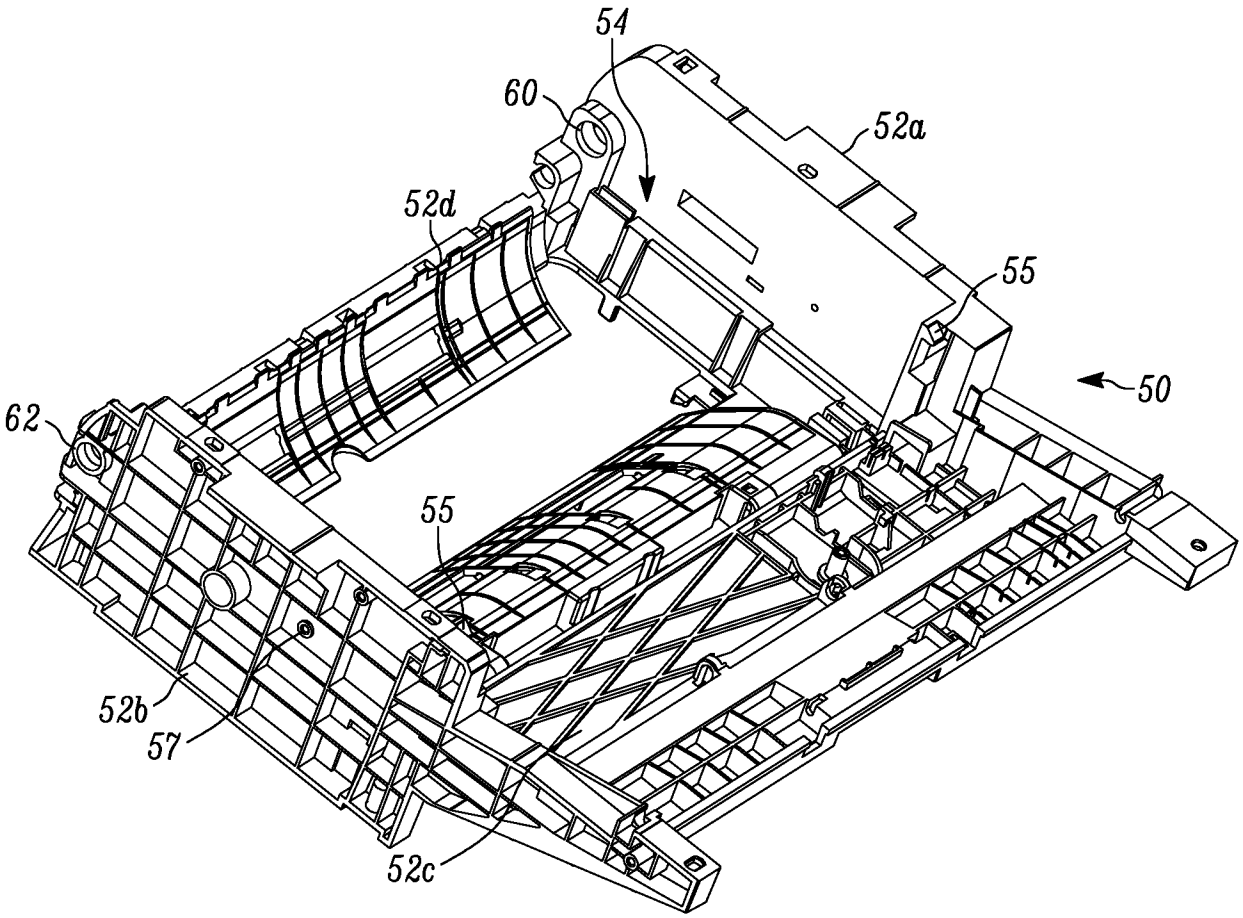
FIG. 2 is an isometric view of a base of the ADF of FIG. 1.

Referring to FIG. 2, the base 50 includes a plurality of walls 52*a*-52*d* that define an interior space 54 extending entirely through the base. The base 50 can have more or less than the four walls 52*a*-52*d* illustrated. The walls 52*a*, 52*b* are configured to extend into the lower tray 30 and the upper tray 40 and are secured thereto. The wall 52*c* is configured to extend into the upper tray 40. In another example (not shown), the base 50 is integrally formed with the lower tray 30 and/or the upper tray 40. Each wall 52*a*, 52*b* includes a projection 55 having, for example, a hook shape. Both projections 55 are positioned at the end of the base 50 adjacent the wall 52*c*. A bearing element 60, 62 extends through each respective wall 52*a*, 52*b*. A threaded opening 57 also extends through the wall 52*b* and/or the wall 52*a* (not shown).

Figure 3A:
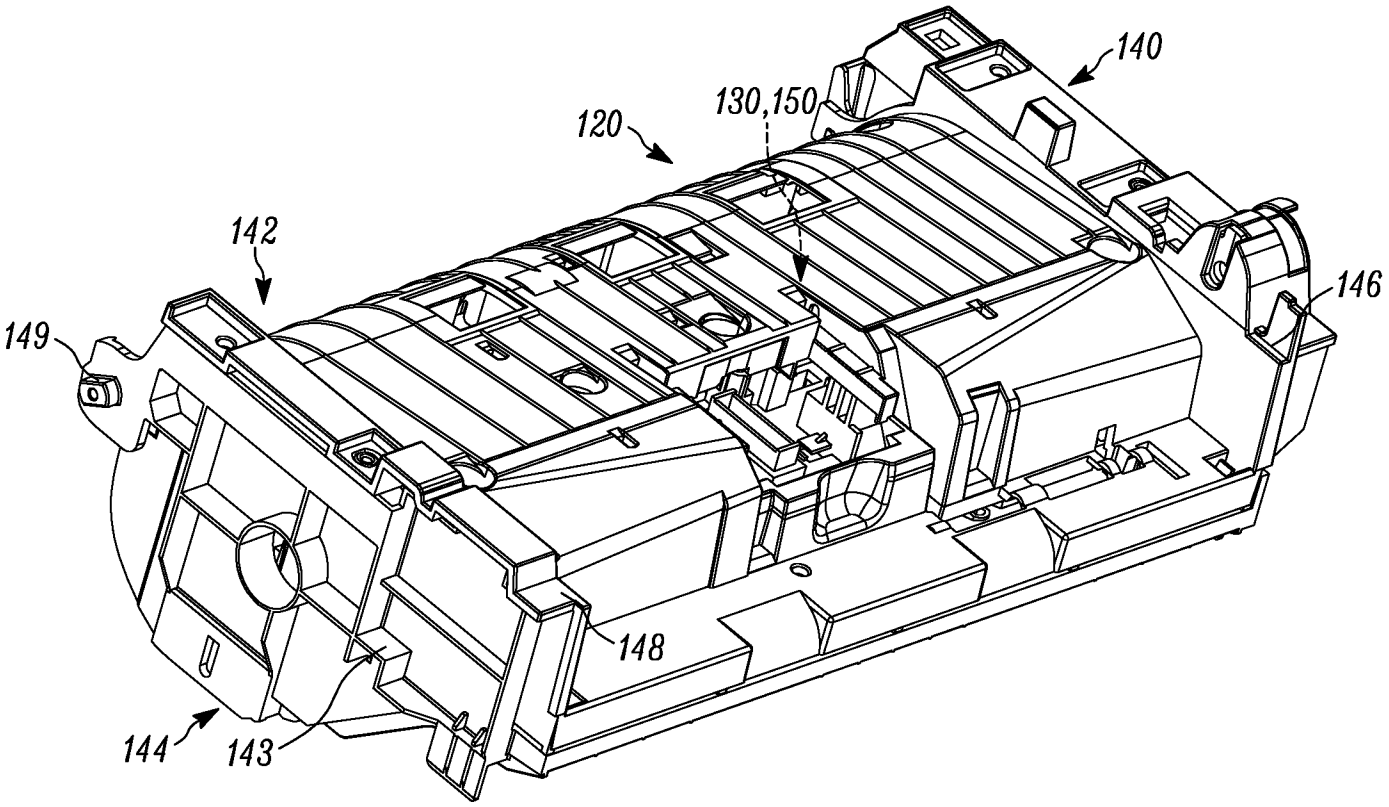
FIG. 3A is a front isometric view of the paper feeding mechanism for placement within the base of FIG. 2.
Figure 3B:
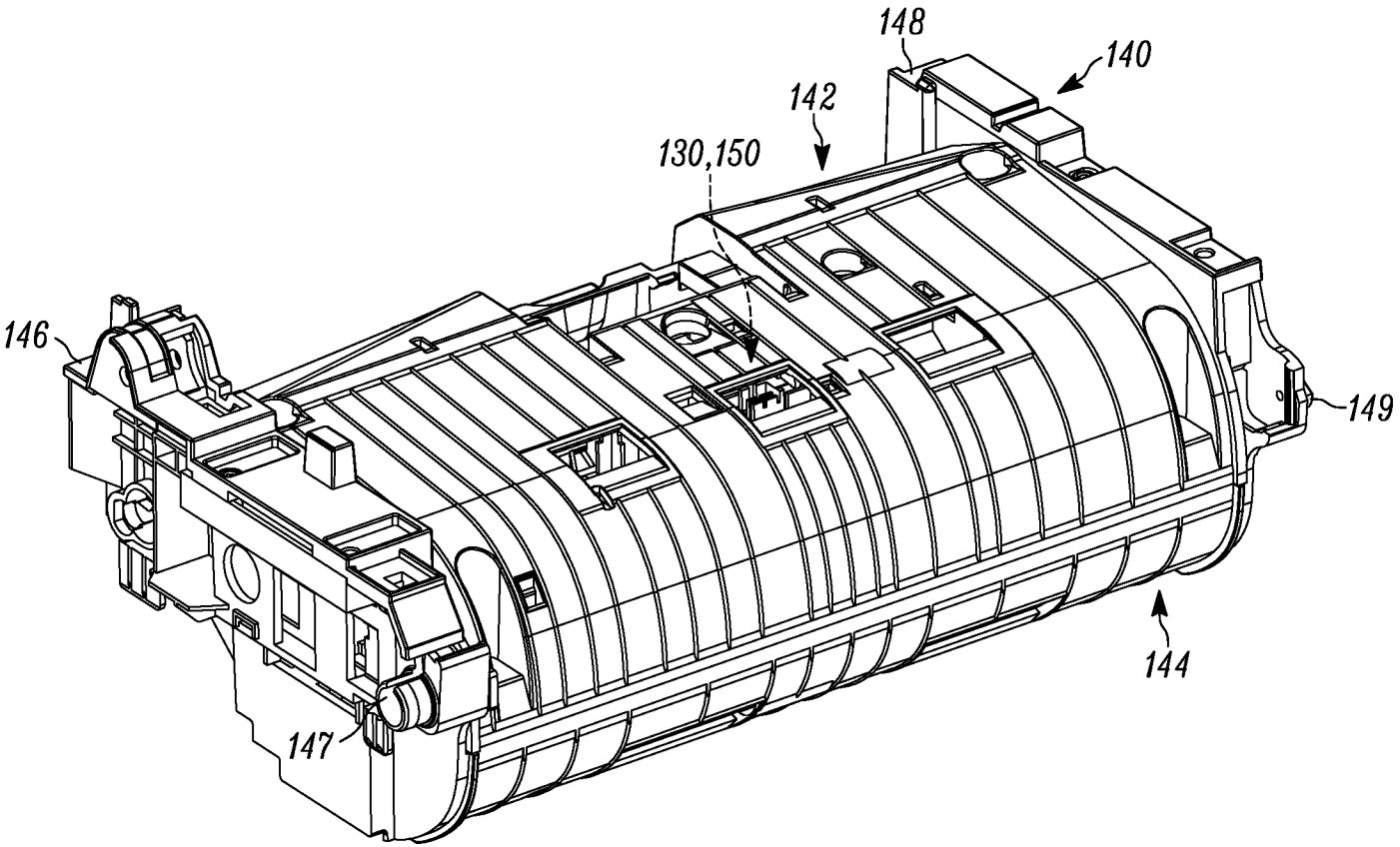
FIG. 3B is a rear isometric view of the paper feeding mechanism of FIG. 3A.
Figure 3C:
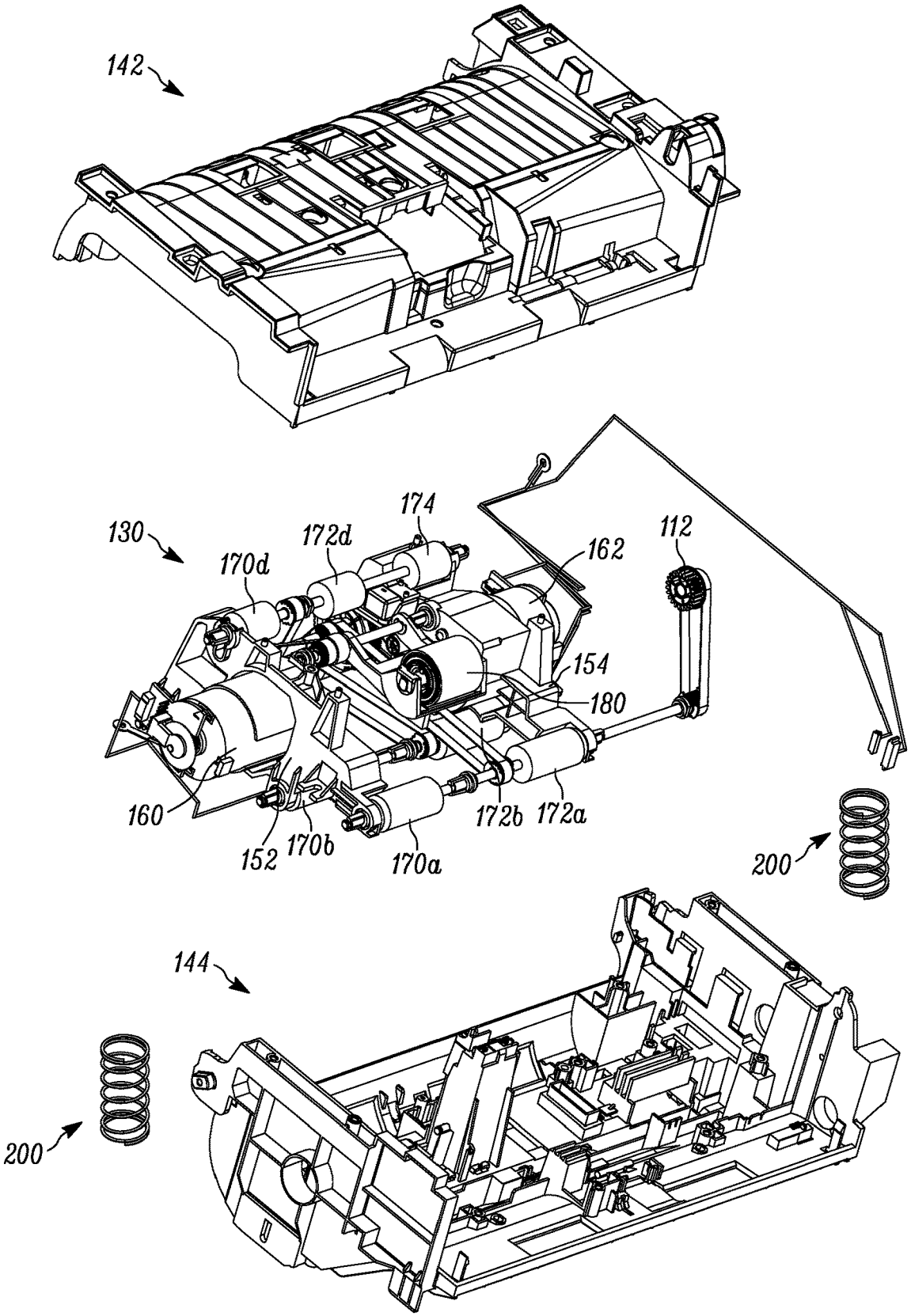
FIG. 3C is an exploded view of the paper feeding mechanism of FIG. 3A.

As shown in FIGS. 3A-3B, the paper feeding mechanism 120 includes a housing 140 having a first component 142 and a second component 144 secured together to define an interior space 150. The first component 142 includes a pair of engagement surfaces 146, 148 on opposite sides of the housing 140. The second component 144 includes a pair of bearing elements 147, 149 on opposite ends of the housing 140 and an engagement surface 143. The paper feeding mechanism 120 is configured to be positioned within the interior space 54 of the base 50 such that the bearing elements 147, 149 are rotatably or pivotably mounted to the bearing elements 60, 62 of the base 50.

A transmission 130 is provided within the interior space 150 of the housing 140 for helping to transport paper from the lower tray 30 to the upper tray 40. The transmission includes a pair of motor brackets 152, 154 secured to respective DC motors 160, 162.

Figure 4A:
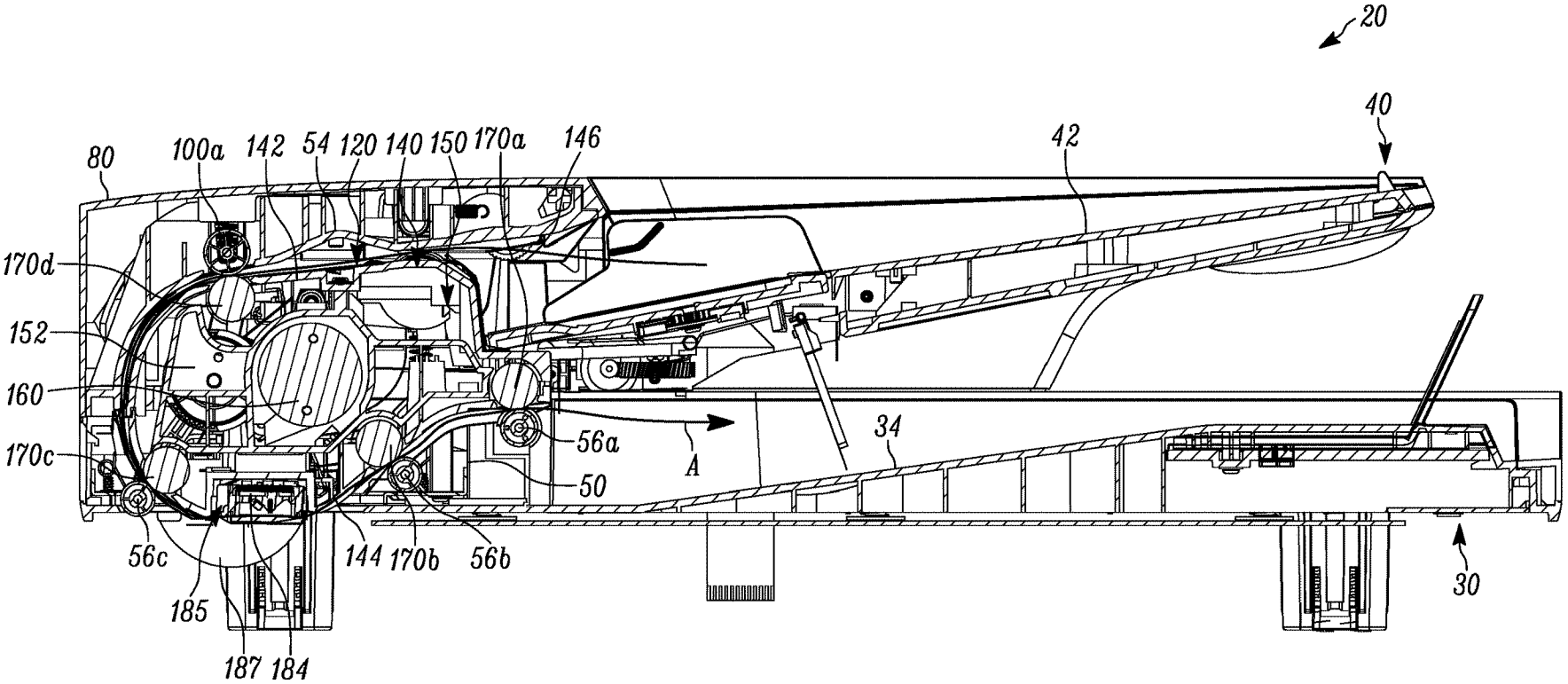
FIG. 4A is a sectional view of the ADF of FIG. 1 taken along line 4A-4A.
Figure 4B:
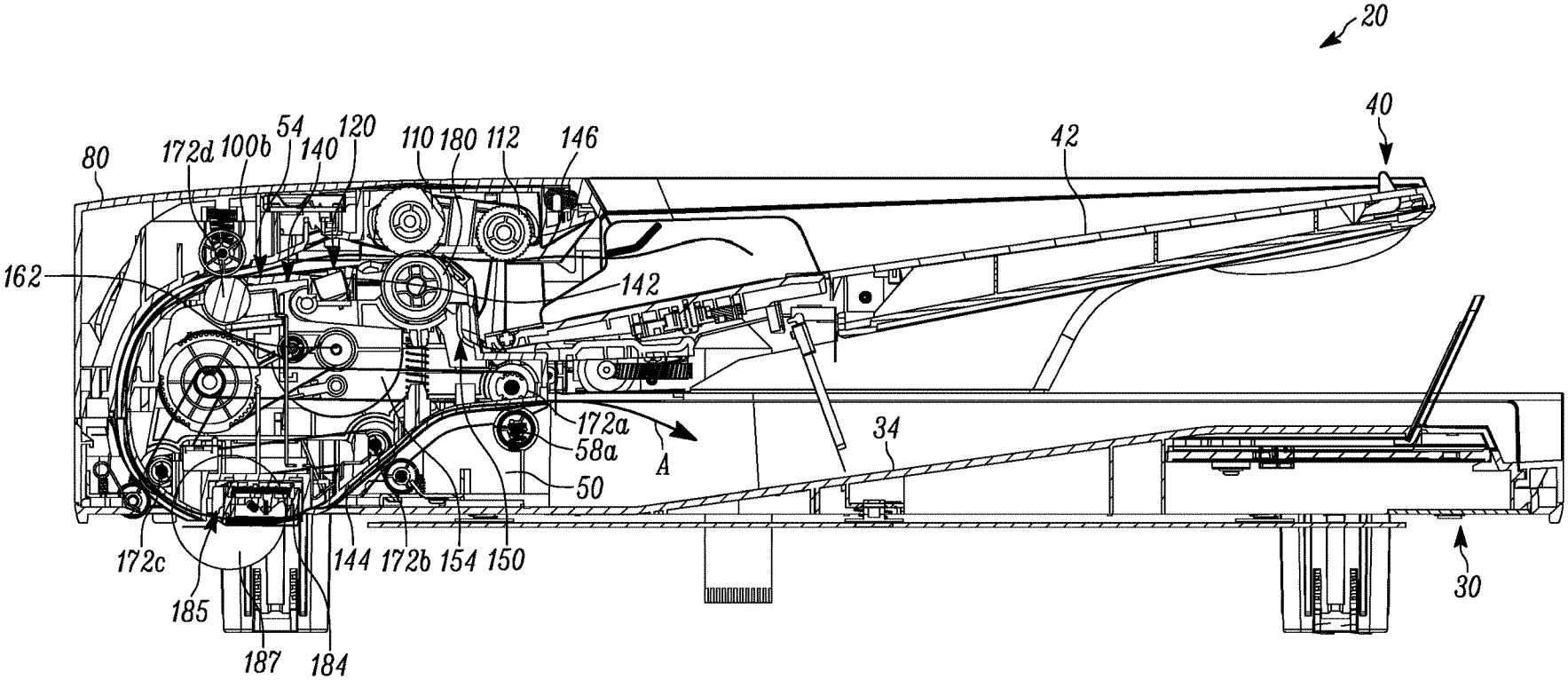
FIG. 4B is a sectional view of the ADF of FIG. 1 taken along line 4B-4B.
Figure 4C:
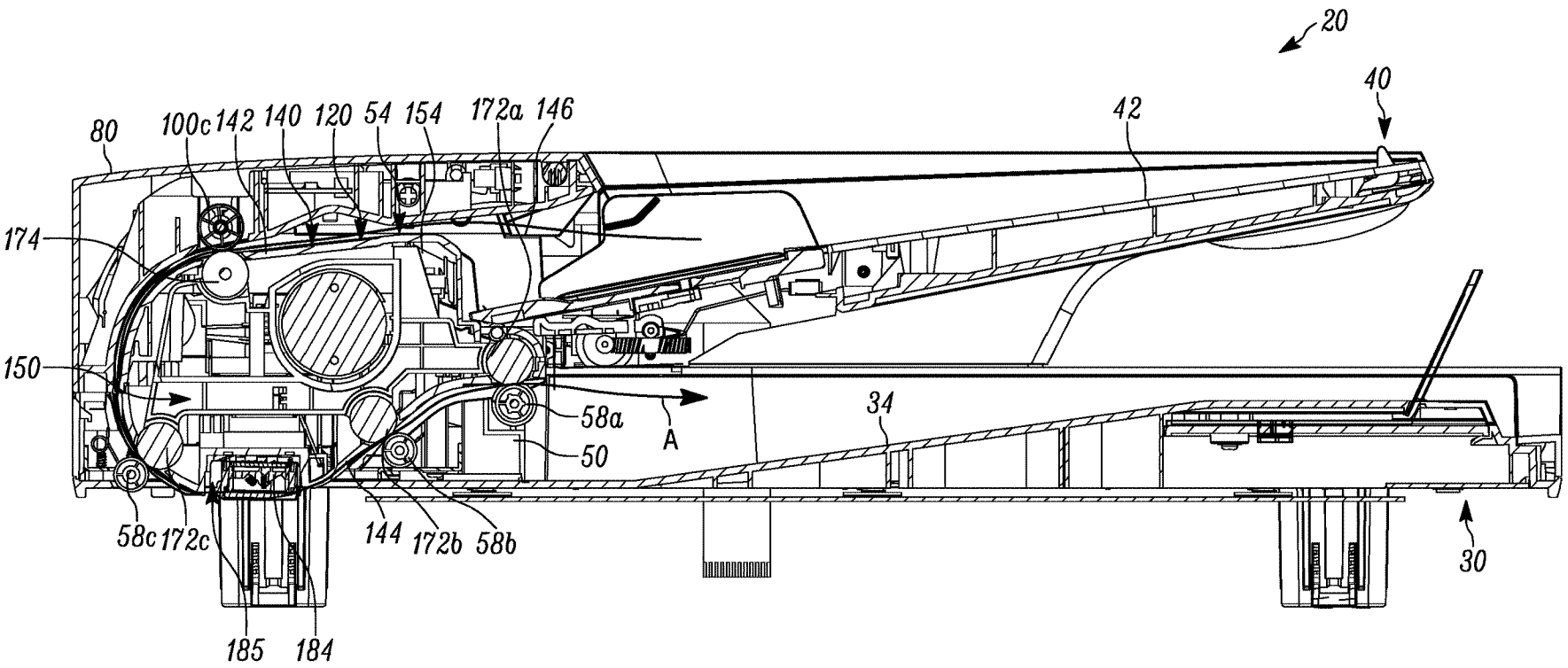
FIG. 4C is a sectional view of the ADF of FIG. 1 taken along line 4C-4C.

Referring further to FIGS. 4A-4C, the motors 160, 162 are coupled to a series of drive rollers 170*a*-170*d*, 172*a*-172*d*, 174 rotatably mounted on the second component 144 so as to transmit rotation to the drive rollers. The motors 160, 162 can be directly or indirectly coupled to the drive rollers 170*a*-170*d*, 172*a*-172*d*, 174 in a known manner via idler gears, belts, pulleys, etc. This coupling can be configured such that either or both motors 160, 162 rotatably drive any or all of the drive rollers 170*a*-170*d*, 172*a*-172*d*, 174.

As shown in FIG. 4A, each drive roller 170*a*-170*c* is associated with idler or pinch rollers 56*a*-56*c* rotatably mounted on the lower tray 30. The drive roller 170*d* is associated with an idler or pinch roller 100*a* rotatably mounted on the cover 80. The drive rollers 170*a*-170*d* and associated pinch rollers 56*a*-56*c*, 100*a* are spaced apart a predetermined distance substantially equal to the width of a sheet of paper to enable these associated roller pairs to grip paper extending therebetween.

As shown in FIG. 4B, each drive roller 172*a*-172*c* is associated with an idler or pinch roller 58*a*-58*c* rotatably mounted on the lower tray 30. The drive roller 172*d* is associated with an idler or pinch roller 100*b* rotatably mounted on the cover 80. The drive rollers 172*a*-172*d* and associated pinch rollers 58*a*-58*c*, 100*b* are spaced apart a predetermined distance substantially equal to the width of a sheet of paper to enable these associated roller pairs to grip paper extending therebetween.

The motor 162 is further coupled to a drive roller 110 rotatably mounted on the cover 80 so as to impart rotation to the drive roller 110. The drive roller 110 is associated with a retarding roller 180 rotatably mounted on the first component 142. The retarding roller 180 is an idler or pinch roller spaced from the drive roller 110 a predetermined distance substantially equal to the width of a sheet of print paper to enable the associated roller pair 110, 180 to grip paper extending therebetween. A pick roller 112 is rotatably mounted on the cover 80 upstream of the rollers 110, 180 adjacent the paper storage area 42. The pick roller 112 is configured to grasp one sheet of paper at a time and draw the sheet into the paper feeding mechanism 120.

Referring to FIG. 4C, the drive roller 174 is associated with an idler or pinch roller 100*c* rotatably mounted on the cover 80. The drive roller 174 and associated idler roller 100*c* are spaced apart a predetermined distance substantially equal to the width of a sheet of paper to enable the roller pair 100*c*, 174 to grip paper extending therebetween.

The rotational axes of the drive rollers 170*a*, 172*a* are coaxial with one another, the rotational axes of the drive rollers 170*b*, 172*b* are coaxial with one another, the rotational axes of the drive rollers 170*c*, 172*c* are coaxial with one another, and the rotational axes of the drive rollers 170*d*, 172*d*, 174 are concentric with one another. Similarly, the rotational axes of the idler rollers 56*a*, 58*a* are coaxial with one another, the rotational axes of the idler rollers 56*b*, 58*b* are coaxial with one another, the rotational axes of the idler rollers 56*c*, 58*c* are coaxial with one another, and the rotational axes of the idler rollers 100*a*-100*c* are concentric with one another.

Consequently, the aforementioned spacing between the drive rollers 170*a*-170*d*, 172*a*-172*d*, 174 and associated idler rollers 56*a*-56*c*, 58*a*-58*c*, 100*a*-100*c* allows paper to be gripped and transported entirely through the paper feeding mechanism 120 in the generally counterclockwise path A shown in FIGS. 4A-4C. The path A is confined to a corridor defined between the exterior of the housing 140 and the base 50. The path A substantially encircles the transmission 130, which advantageously results in a more compact paper feeding mechanism 120, e.g., minimizing depth in the front-to-rear direction, compared to devices that position the transmission outside the paper transport path.

The paper passes over a device 184 while being transported along the path A. As shown in FIGS. 4A-4C, the device 184 is positioned in an exterior passage 185 formed in the second component 144 such that the path A extends outward of or below the device. The device 184 extends generally perpendicular to the trays 30, 40 and across the entire width of the path A. The device 184 constitutes a scanner for capturing the image of one side of the paper as it passes underneath the device 184. The device 184 also applies an outward or downward biasing force to the paper to ensure that the paper properly passes over another scanner 187 in the all-in-one printer, scanner, etc. (see FIGS. 4A and 4C) in a known manner. The scanner 187 captures the image of the other side of the paper as it passes over the scanner 187. The scanned paper can either be copied to memory and/or physically copied. In any case, the paper subsequently exits the paper feeding mechanism 120 through the associated pairs of rollers 58*a*-58*c* and 172*a*-172*c*.

Under normal operating conditions, the cover 80 abuts the engagement surfaces 146, 148 on the housing 140 to keep the paper feeding mechanism 120 (and therefore the transmission 130) in a gripping position in which paper can be gripped and transported along the path A. In the gripping position, the paper feeding mechanism 120 is prevented from moving about the bearing elements 60, 147 and 62, 149.

During operation, one or more pieces of paper are stacked in the storage area 42 of the upper tray 30 (not shown). When the ADF 20 job is initiated by the user, the motors 160, 162 are actuated to draw a single piece of paper from the storage area 42 into the paper feeding mechanism 120. Actuating the motors 160, 162 causes the pick roller 112 to pull a single piece of paper inward until it is positioned between and grasped by the associated roller pair 110, 180 (see FIG. 4B). The paper is subsequently transferred to successive pairs of associated rollers along the path A, scanned by the device 184, and ultimately expelled from the paper feeding mechanism 120 and deposited in the paper receiving area 34 of the lower tray 30.

Figure 5:
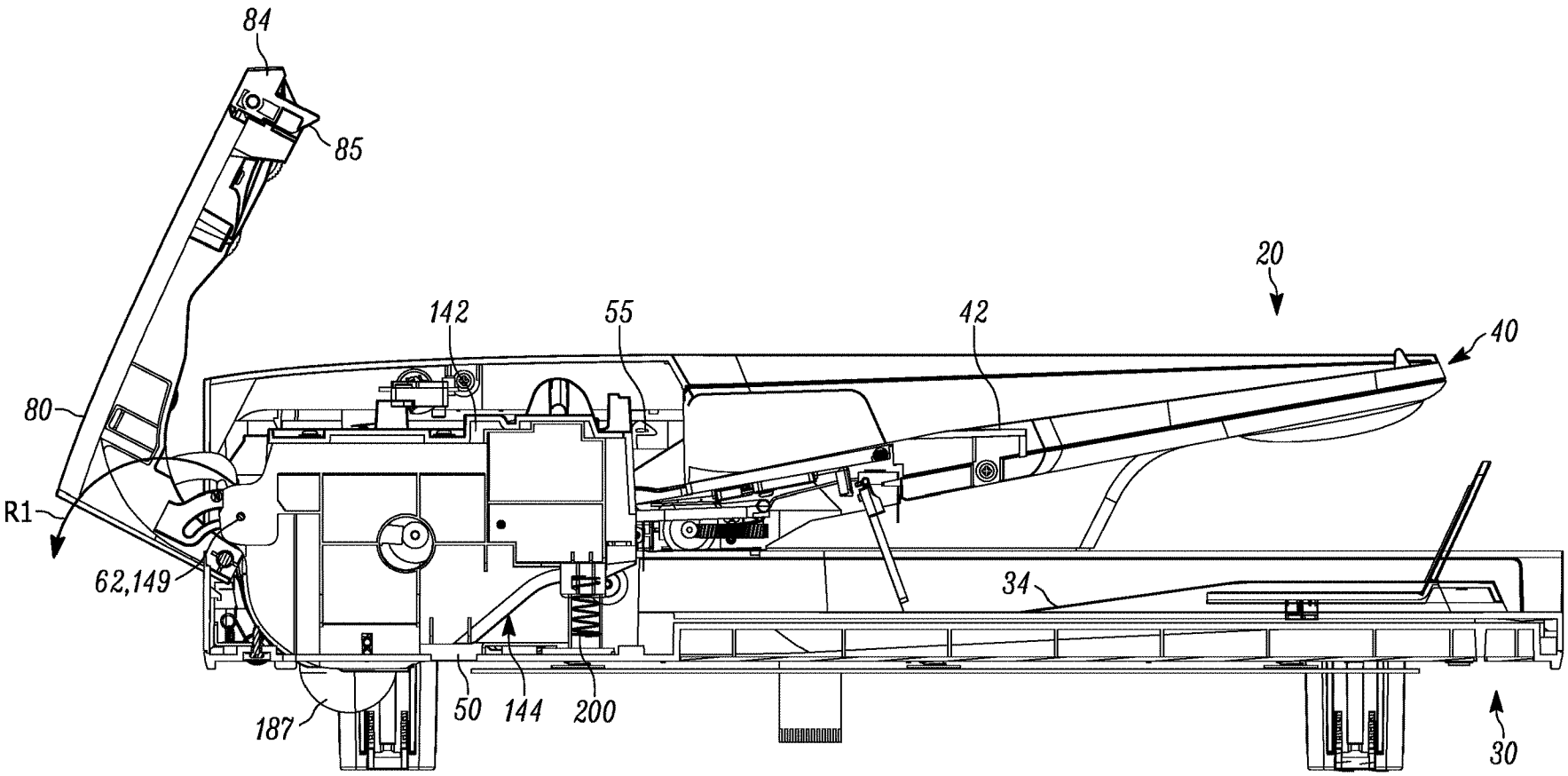
FIG. 5 is a right side section view of the ADF of FIG. 1 in a second condition.
Figure 6:
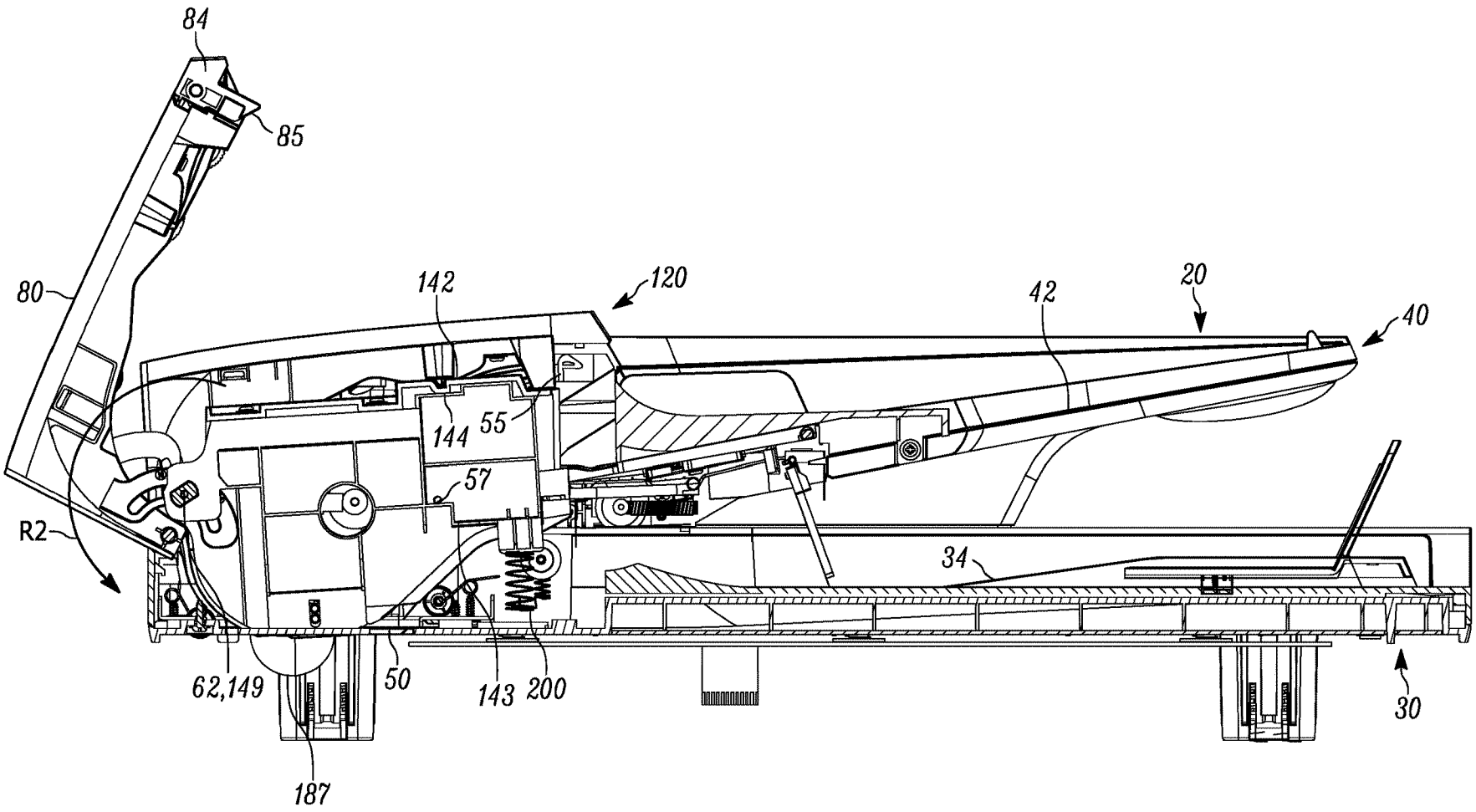
FIG. 6 is a section view of a portion of the ADF of FIG. 1.
Figure 7:
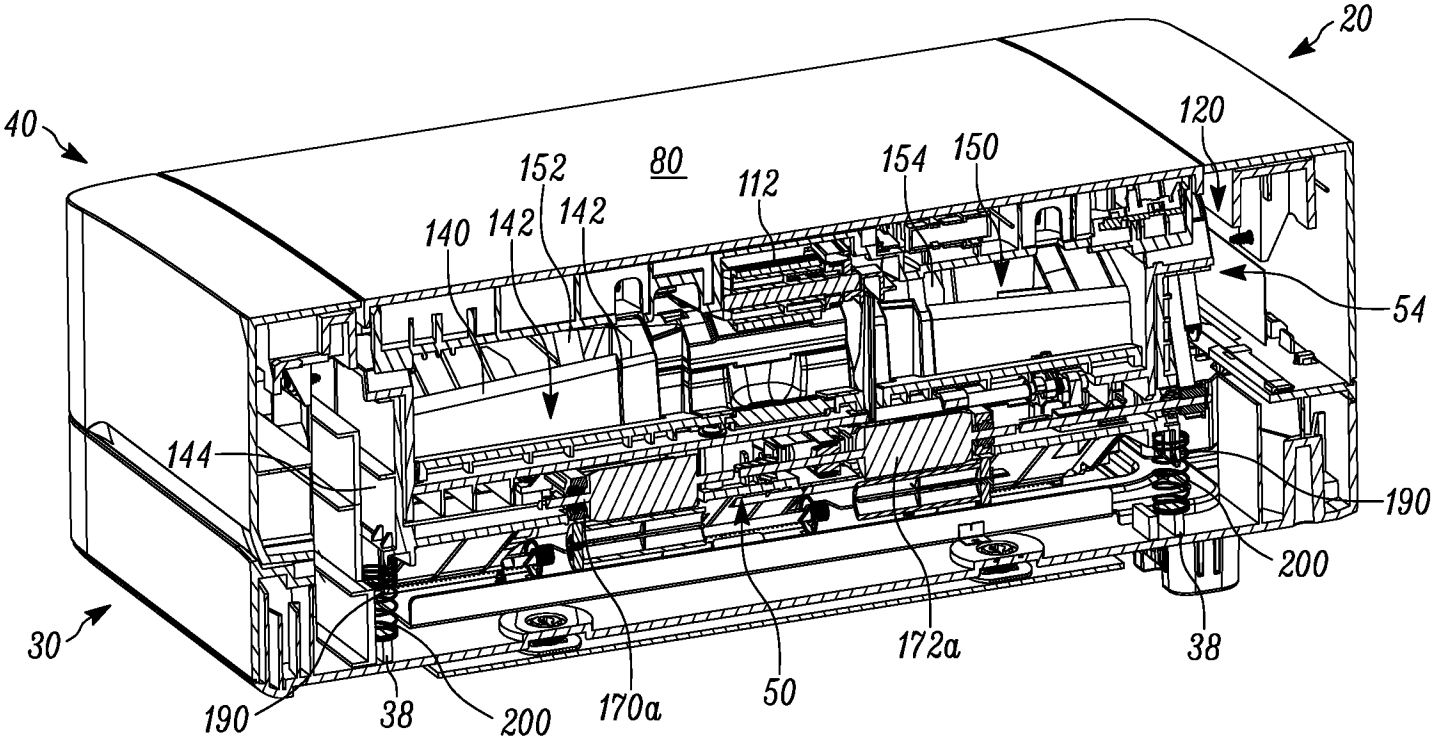
FIG. 7 is a right side section view of the ADF of FIG. 1 in a first condition.

In some instances, the paper can become jammed, misaligned, ripped, etc. as it is transported through the feed roller assembly 120. Referring to FIGS. 4B and 5, when a paper jam occurs along the path A, the user pulls the handle 84 to pivot the cover 80 upwards and away from the upper tray 40 in the manner indicated at R1. Pulling the handle 84 initially causes hook-shaped latches 85 on the cover 80 to disengage from the projections 55 on the base 50, thereby allowing the cover to pivot in the manner R1. When this occurs, the idler rollers 100*a*-100*c* and drive roller 110 are moved out of the gripping position from the associated rollers 170*d*, 172*d*, 174, 180 on the paper feeding mechanism 120.

Pivoting the handle 84 in the manner R1 allows the cover 80 to move out of abutment with the surfaces 146, 148. This in turn allows the paper feeding mechanism 120 to pivot about the bearing elements 60, 147 and 62, 149 within the interior space 54 of the base 50 in the manner indicated at R2 in FIG. 6. The base 50 is configured to allow the paper feeding mechanism 120 to pivot in the manner R2 relative to not only the base but also relative to both trays 30, 40. The degree to which pivoting is permitted can vary but in one example, the paper feeding mechanism 120 can pivot in the manner R2 about 4-6° until the engagement surface 143 on the second component 144 abuts a screw (not shown) threaded into and through the opening 57 in the base 50 (see also FIGS. 2 and 3A).

Compression springs 200 extend between projections 38 on the lower tray 38 and projections 190 on the second component 144 and bias the paper feeding mechanism 120 to pivot in the manner R2 upwards towards the pivoted cover 80 into a release position. In another example (not shown), the compression springs are omitted and pivoting of the paper feeding mechanism 120 in the manner R2 is accomplished manually.

In any case, pivoting the feed roller assembly 120 in the manner R2 causes the drive rollers 170*a*-170*c* to move out of the gripping position with the associated idler rollers 52*a*-52*c*. The drive rollers 172*a*-172*c* are simultaneously moved out of the gripping position with the associated idler rollers 58*a*-58*c*. This releases the jammed paper from any grip between the associated pairs of rollers 170*a*-170*c*, 52*a*-52*c* and 172*a*-172*c*, 58*a*-58*c*.

Once the paper feeding mechanism 120 is moved to the release position, the user is not only capable of readily accessing the paper jam but also removing the paper from the feed roller assembly since all grip pressure between the paper and the rollers is removed. After the paper jam is remedied the user pivots the paper feeding mechanism 120 downward against the bias of the compression springs 200 (when present) toward the lower tray 30 (in the direction opposite the direction R2). The cover 80 is then pivoted downwards towards the paper feeding mechanism 120 (in the direction opposite the direction R1) until the latches 85 overlap and lock with the projections 55 on the base 50. Alternatively, the user can simply pivot the cover 80 downwards into engagement with the released paper feeding mechanism 120 and thereby use the cover to pivot the paper feeding mechanism downward until the latches 85 snap or latch onto the projections 55. In either case, the paper feeding mechanism 120 is returned to the gripping position and held in the gripping position by the connections between the latches 85 and projections 55.

Although the paper feeder mechanism 120 is shown as being pivotably connected to the base 50 via the bearing elements 60, 147 and 62, 149, the paper feeder mechanism could also be longitudinally movable relative to the base. For example, the housing 140 could be connected to the base 50 via cooperating pin and elongated slot or a rack and pinion connection. Consequently, pivoting the cover 80 in the manner R1 would allow the paper feeder mechanism 120 to move longitudinally relative to the base instead of in a pivoting manner. This relative longitudinal movement would also be relative to both trays 30, 40 due to the fixed connection between the trays and the base.

The configuration of the paper feeding mechanism 120 is advantageous in that it allows jammed paper to be removed with minimal resistance and without having the user interact with secondary mechanisms. The paper feeding mechanism 120 also does not require articulated enclosure parts to provide relative movement between the housing 140 and base 50, which can be perceived as inexpensive and/or not robust.

What is claimed is:

1. A paper feeding mechanism for an automatic document feeder having an upper tray for storing paper, a lower tray for receiving paper, a base connecting the upper tray to the lower tray, and a cover pivotally connected to the upper tray, the mechanism comprising:

a housing provided within the base and being movable relative to the base; and a transmission having a gripping position for transporting paper from the upper tray to the lower tray along a path around an exterior of the housing, including a lower path portion between the base and the housing, and a release position in which the housing is separated from the base, releasing the paper in the lower path portion between the base and the housing and allowing a paper jam along the path to be remedied;

at least one spring for biasing the housing away from the lower tray to place the transmission in the release position;

the cover being pivotable between a first condition that prevents relative movement between the housing and the base to maintain the transmission in the gripping position to a second condition that allows the housing to move relative to the upper tray and the lower tray to place the transmission in the release position.

2. The mechanism recited in claim 1, wherein the housing is pivotably connected to the base such that movement of the cover to the second condition allows the housing to pivot relative to the upper tray and the lower tray and place the transmission in the release position.

3. The mechanism recited in claim 2, further comprising at least one spring for biasing the housing away from the lower tray to place the transmission in the release position.

4. The mechanism recited in claim 1, wherein the transmission includes a plurality of drive rollers rotatably mounted on the housing and driven by at least one motor connected to the housing, the drive rollers cooperating with idler rollers on the lower tray and the cover to transport paper along a path from the upper tray to the lower tray when the transmission is in the gripping position, the drive rollers being moved away from the idler rollers to allow a paper jam along the path to be remedied when the transmission is in the release position.

5. The mechanism recited in claim 1, wherein the paper transport path extends around the transmission.

6. An automatic document feeder comprising:

an upper tray for storing paper;

a lower tray for receiving paper;

a cover pivotally connected to the upper tray;

a base connecting the upper tray to the lower tray and defining an interior space; and a paper feeding mechanism comprising:

a housing provided in the interior space and being movable relative to the base; and a transmission having a gripping position for transporting paper from the upper tray to the lower tray along a path around an exterior of the housing, including a lower path portion between the base and the housing, and a release position in which the housing is separated from the base, releasing the paper in the lower path portion between the base and the housing and allowing a paper jam along the path to be remedied;

at least one spring for biasing the paper feeding mechanism away from the lower tray to place the transmission in the release position;

the cover being pivotable between a first condition that prevents relative movement between the housing and the base to maintain the transmission in the gripping position to a second condition that allows the housing to move relative to the upper tray and the lower tray to place the transmission in the release position.

7. The automatic document feeder recited in claim 6, wherein the transmission includes a plurality of drive rollers rotatably mounted on the housing and driven by at least one motor connected to the housing, the drive rollers cooperating with idler rollers on the lower tray and the cover to transport paper along a path from the upper tray to the lower tray when the transmission is in the gripping position, the drive rollers being moved away from the idler rollers to allow a paper jam along the path to be remedied when the transmission is in the release position.

8. The automatic document feeder recited in claim 7, wherein the at least one motor comprises first and second motors.

9. The automatic document feeder recited in claim 8, further comprising at least one spring for biasing the paper feeding mechanism away from the lower tray to place the transmission in the release position.

10. The automatic document feeder recited in claim 6, wherein the housing is pivotably connected to the base such that movement of the cover to the second condition allows the housing to pivot relative to the upper tray and the lower tray and place the transmission in the release position.

11. The automatic document feeder recited in claim 6, wherein the paper transport path extends around the transmission.

12. The automatic document feeder recited in claim 6, wherein the cover forms a latching connection with the base to maintain the transmission in the gripping position.

13. An all-in-one printer comprising:

a main body including a user interface;

an automatic document feeder pivotally connected to the main body, comprising:

an upper tray for storing paper;

a lower tray for receiving paper;

a cover pivotally connected to the upper tray;

a base connecting the upper tray to the lower tray and defining an interior space; and a paper feeding mechanism comprising:

a housing provided in the interior space and being movable relative to the base; and a transmission having a gripping position for transporting paper from the upper tray to the lower tray along a path around an exterior of the housing; including a lower path portion between the base and the housing, and a release position in which the housing is separated from the base, releasing the paper in the lower path portion between the base and the housing and allowing a paper jam along the path to be remedied;

at least one spring for biasing the paper feeding mechanism away from the lower tray to place the transmission in the release position;

the cover being pivotable between a first condition that prevents relative movement between the housing and the base to maintain the transmission in the gripping position to a second condition that allows the housing to move relative to the upper tray and the lower tray to place the transmission in the release position.

* * * * *